United States Patent [19]

Braddick et al.

[11] 4,281,711

[45] Aug. 4, 1981

[54] APPARATUS FOR POSITIONING A LINER ON A TUBULAR MEMBER IN A WELL BORE WITH A RETRIEVABLE PACK OFF BUSHING THEREBETWEEN

[75] Inventors: Britt O. Braddick, Houston; Hiram E. Lindsey, Midland, both of, Tex.

[73] Assignee: Texas Iron Works, Inc., Houston, Tex.

[21] Appl. No.: 555,691

[22] Filed: Mar. 5, 1975

Related U.S. Application Data

[62] Division of Ser. No. 440,714, Feb. 8, 1974, Pat. No. 3,920,075.

[51] Int. Cl.[3] ..... E21B 33/14

[52] U.S. Cl. ..... 166/118; 166/217; 166/237; 285/3; 285/307; 285/319

[58] Field of Search ..... 166/123, 124, 128, 133, 166/138, 208, 217, 226, 125, 118, 237; 285/3, 18, 133, 319

[56] References Cited

U.S. PATENT DOCUMENTS

| | | | |
|---|---|---|---|
| 2,901,045 | 8/1959 | Schramm | 166/125 |
| 2,948,338 | 8/1960 | Raulins et al. | 166/123 |
| 2,972,381 | 2/1961 | Raulins | 166/125 |
| 2,980,185 | 4/1961 | Daffin | 166/123 X |
| 3,291,220 | 12/1966 | Mott | 166/208 |
| 3,335,802 | 8/1967 | Seyffert | 166/226 |
| 3,460,617 | 8/1969 | Brown et al. | 166/208 |
| 3,489,221 | 1/1970 | Crain et al. | 166/290 |
| 3,507,329 | 4/1970 | Stone | 166/217 |
| 3,556,220 | 1/1971 | Schwegman | 166/290 |
| 3,608,634 | 9/1971 | Cochran | 166/124 |
| 3,863,961 | 2/1975 | Dinning | 285/3 |

*Primary Examiner*—Stephen J. Novosad
*Attorney, Agent, or Firm*—Jack W. Hayden

[57] ABSTRACT

A method and apparatus for positioning and bonding a liner in a casing in a well bore wherein a pack off bushing is provided between the liner and the well string on which the liner is lowered into the well bore for discharge of a bonding agent through the well string and around the liner in the well bore.

The seal or pack off bushing is constructed and arranged so that it may be retrieved after the positioning and bonding operations are completed along with the well string upon which the liner is initially lowered into the well bore.

25 Claims, 11 Drawing Figures

APPARATUS FOR POSITIONING A LINER ON A TUBULAR MEMBER IN A WELL BORE WITH A RETRIEVABLE PACK OFF BUSHING THEREBETWEEN

This is a division of application Ser. No. 440,714, filed Feb. 8, 1974, now U.S. Pat. No. 3,920,075.

SUMMARY OF THE INVENTION

The practice of setting liners in a casing in a well bore is well known and has been utilized for many years. There are several generally accepted arrangements for accomplishing such purpose.

In one arrangement, a liner is secured on a tubular member forming part of a well string and a hanger is mounted on the outside of the liner. The tubular member includes an extension which extends downwardly into the liner and in one arrangement a plurality of downwardly facing swab cups are positioned between the tubular member and the liner.

The liner is supported on the tubular member in a well known manner, to enable them to be separated upon relative rotation after the liner has been positioned in the well bore. The liner hanger in turn is supported on the liner in a well known manner and the well string including the tubular member with the liner and hanger is lowered to the desired location in the casing in the well bore. The hanger is unlocked from the liner by relative rotation between the well string and the liner with the hanger thereon in a manner well known in the art. The hanger includes bow spring means which engage the casing and after the hanger has been unlocked from the liner, the bow springs restrain the hanger upon downward movement of the well string. This causes slip segments carried by the hanger to move up on a tapered, outwardly projecting surface on the liner so that the slip segments expand radially outwardly to engage and lock against the adjacent casing. This locks the hanger and liner in position in the casing.

Thereafter rotation of the well string causes relative rotation between the well string and the liner so to disengage the well string from the liner. To assure that the liner and well string have been disengaged the well string is generally lifted upwardly a suitable distance in the well bore and the weight noted on the weight indicator at the earth's surface so that it may be instrumentally or visually determined that the liner has actually been disengaged from the well string and supported on the casing in the well bore. The well string extends within the liner a suitable extent so that the well string may be lifted a desired amount without withdrawing the downwardly facing swab cup packers of the prior art from the interior of the liner. The well string is then set down against the liner.

Thereafter a bonding agent such as by way of example only, an epoxy resin or cement may be discharged down the well string, and out the lower end thereof and around the liner between the liner and the well bore and between the liner and casing a predetermined or desired vertical extent.

This type setting arrangement has several disadvantages. First of all, if the cement discharged down the well string creates a differential pressure such that internal pressure at the setting tool swab cup packers is less than pressure in the annulus, drilling fluid may be sucked into the liner in a manner so as to comingle with the cement which is undesirable. Additionally, if the hydraulic pressure acting upwardly against the swab cups becomes excessive, this may cause cork screwing of the tail pipe or extension of the well string within the liner which is also undesirable.

To overcome some of the above objections, a sealing arrangement between the well string and liner is employed in some situations comprising a drillable bushing which is threadedly secured in position in the liner and is left in the liner after the cementing operations have been completed. This causes some difficulty in that when it is necessary to drill out the liner, that is, to deepen the well bore, then the bushing must be drilled by methods well known in the art which is time consuming and expensive. Additionally, in such arrangements a drillable seal bushing is not reuseable.

Even in those situations where a swab packer arrangement is employed, the swab packers may be damaged either during use, or upon withdrawal from the well bore so as to render them undesirable for further use.

Also, the swab cup packers, being formed of an elastomer are not useable where the well temperatures are in excess of what the elastomer may withstand, or if the combination of temperature and pressure is in excess of the cup's rating.

In operations where a device (such as a multiple plug mechanism) must be attached to the setting tool tailpipe, it is desirable, if not mandatory that means be provided for pulling the connector for such device out with the setting tool. This precludes use of drillable pack-off bushing and makes a retrievable pack-off bushing necessary.

In some instances, a liner is set in a well bore without hanging it in a casing. In this event, subsequent operations carried out as described hereinabove encounter similar objections to those encountered where the liner is hung in the casing, as described.

The present invention provides an apparatus and method for attempting to overcome the above and other problems encountered in setting a liner in a casing in a well bore.

Yet a further object of the present invention is to provide a method of retrieving a seal bushing located between a liner and a well string, or setting string after the liner has been set in the well bore and as the setting string, or well string, is retrieved from the well bore.

Still another object of the present invention is to provide a retrievable seal bushing for locking and sealing between a liner and a well string on which the liner is supported for conducting bonding operations in a well bore, which seal bushing may be retrieved from the well bore along with the well string as the well string is withdrawn after bonding operations are completed.

Other objects and advantages will become more apparent from a consideration of the following description and drawings.

DESCRIPTION OF THE PREFERRED EMBODIMENT

Figure 1:
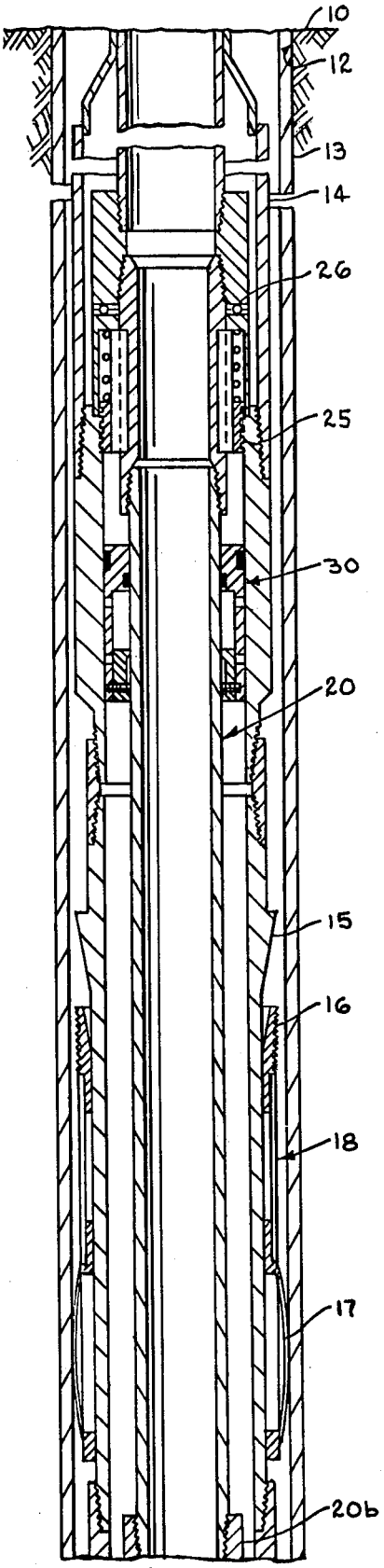
FIG. 1 is a vertical sectional view illustrating a well string being lowered into a well bore with a liner and hanger supported thereon with one form of a seal bushing of the present invention positioned between the well string and the liner.

In FIG. 1 the earth's surface is illustrated by the numeral 10 and the well bore generally by the numeral 12. A casing 13 is shown as extending from the earth's surface downwardly into the well bore a suitable extent, and if desired several diameters of casing may be concentrically positioned one within the other in a manner well known in the art.

A well string or setting string referred to generally at 20 is shown as being lowered into the well bore 12 from the earth's surface, and the well string has supported thereon a liner 14 with a hanger schematically illustrated at 18 carried on the liner.

The well string 20 and liner are secured together by means well known in the art, schematically illustrated at 25 so that they may be separated when desired by relative rotation as will be described with regard to FIG. 3. To accommodate such rotation, a suitable bearing race schematically illustrated at 26 is provided between the well string 20 and the liner 14 in a manner well known in the art.

Figure 2:
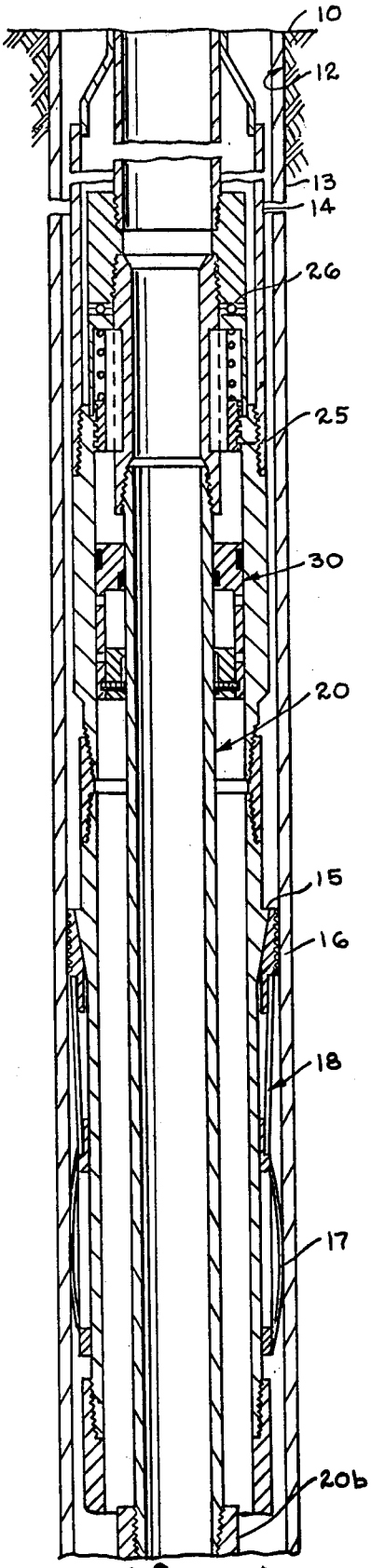
FIG. 2 illustrates schematically the relative position of the well string to the liner, and the liner to the hanger, after the well string has been rotated to disengage the hanger from the liner and the hanger engaged with the casing in the well bore upon further downward movement of the well string and liner relative to the hanger.

The liner 14, when it is to be hung in the casing 13 in the well bore 12, includes a conical surface 15 on the outer surface thereof and the hanger 18 is carried on the liner 14 by suitable means such as a J-slot and lug arrangement well known in the art, so that when the desired elevation is reached in the well bore 12 at which it is desired to connect the liner 14 to the casing 13, the well string 20 may be rotated to disengage the J-slot and lug arrangement in a manner well known in the art. As previously mentioned, the hanger 18 has bow springs 17 thereon which drag against the casing 13 and retard movement of the hanger 18 whereupon further downward movement of the well string 20 and liner 14 as illustrated in FIG. 2 of the drawings causes the liner hanger 18 to force the slip segments 16 thereon upwardly on the conical surface 15 thus expanding the slip segments 16 radially outward into locking engagement with the casing 13. This position is schematically illustrated in FIG. 2.

Prior to the time that the liner 14 is cemented or otherwise bonded in place in the casing, it is desired to disconnect the well string 20 from the liner 14 so that should some malfunction occur during cementing or bonding operations, the drill string may be quickly withdrawn or retrieved from the well bore, thereby avoiding loss of the well string or setting string 20.

The arrangement referred to generally at 25 forming a threaded connection between the well string 20 and liner 14 enables the well string 20 to be rotated after the slip hanger 18 has been engaged with the casing 13 as previously described with regard to FIG. 2 so as to unlatch the well string 20 from the liner 14.

It will be noted that the well string 20 extends downwardly into the liner a suitable distance, and normally, it is desirable to elevate the well string 20 after disengaging it from the liner 14 and before further operations are conducted to assure that the liner 14 has been disconnected from the well string 20 and hung in the casing. To accomplish this, the well string 20 is elevated at the earth's surface a suitable extent to accommodate for any stretch in the well string 20 and by visually or instrumentally noting the weight indicator at the earth's surface, and by a knowledge as to the length of the well string, the weight of the well string can be determined so that it can thus be ascertained whether or not only the well string 20 is supported at the earth's surface, and if the liner 14 has been properly disconnected therefrom and engaged with the casing 13.

After it has been ascertained that the drill string or well string 20 is disconnected from the liner 14, and the liner 14 suspended by the hanger 18 on the casing 13, cement, or other suitable bonding agent, may be discharged down the well string 20 from the earth's surface and out the lower end of the well string and liner 14 and into the space 28 between the liner 14 and the well bore wall. The cement or other bonding agent is permitted to extend a desired vertical extent in the well bore upwardly between the casing 13 and liner 14 and between the liner 14 and adjacent well bore to assure that the liner 14 will be properly positioned and retained in the casing 13 and the open well bore below the casing and in which the liner extends.

Heretofore, various types of packing arrangements have been provided between the well string 20 and liner 14 in an endeavor to assure proper sealing therebetween as noted previously herein.

Figure 3:
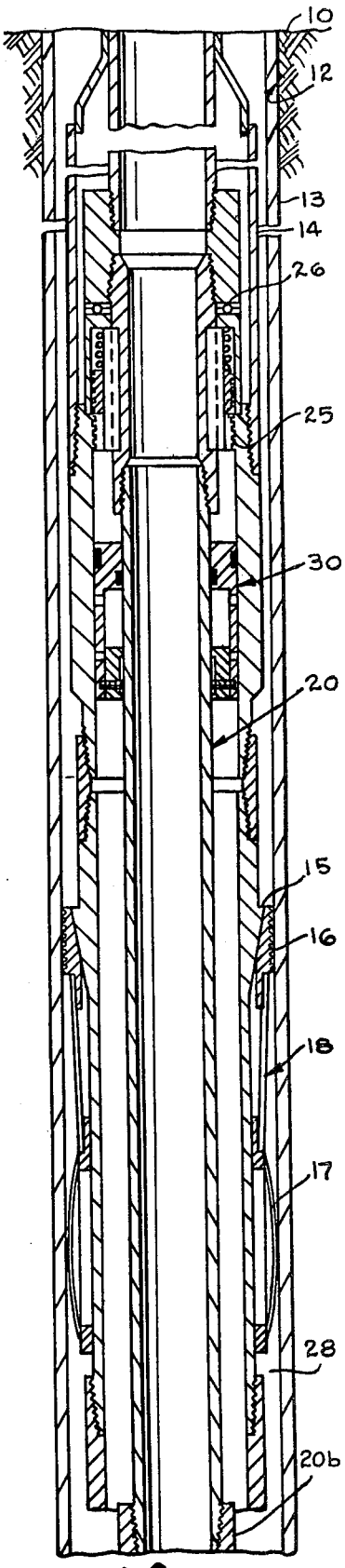
FIG. 3 illustrates the relative position of the well string to the liner, after the well string has been rotated for disengagement from the liner and ready to receive a bonding agent from the earth's surface.
Figure 4:
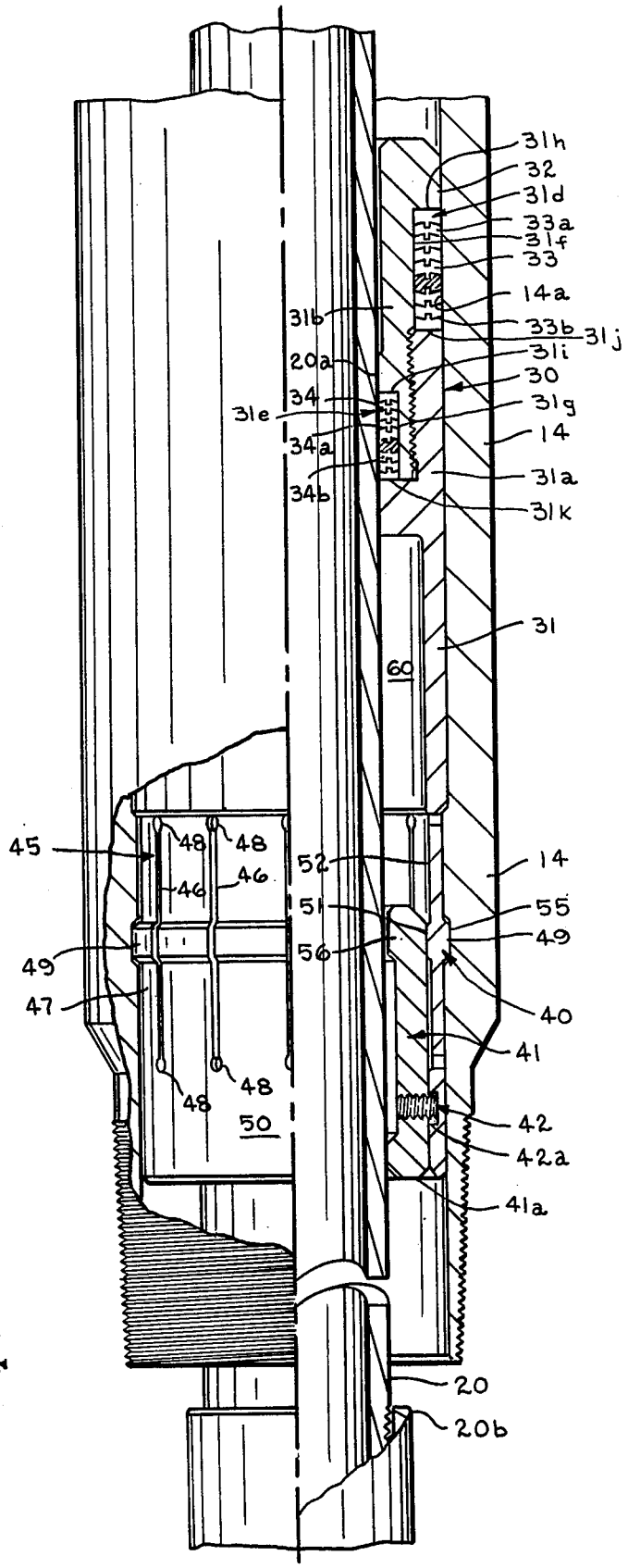
FIG. 4 is an enlarged detail of FIG. 3 illustrating a form of the retrievable pack off or seal bushing employed in the method and apparatus of the present invention.

One form of the device of the present invention is referred to generally at 30 in each FIGS. 1, 2 and 3 and is shown in greater detail in FIG. 4 of the drawings.

The form of the retrievable pack off assembly 30 is shown in FIG. 4 and includes a cylindrical body 31 of suitable longitudinal extent and having inner and outer surfaces as illustrated in FIG. 4 of the drawings. Adjacent one end 32 of the tubular body 31, suitable packing means as illustrated at 33 and 34 is provided, the packing 33 is adapted to engage the inner periphery 14*a* of the liner 14 and the packing 34 engages the outer periphery 20*a* of the well string 20. If desired, the body 31 may be formed by the pair of annular portions 31*a* and 31*b* which may be threadedly engaged to accommodate the packing means 33 and 34 as shown.

The portion 31*b* is provided with a recess 31*d* and 31*e* formed by the circumferential surfaces 31*f* and 31*g* and radially extending end surfaces 31*h* and 31*i* respectively. The other portion 31*a* includes end surfaces 31*j* and 31*k* which are spaced from the surfaces 31*h* and 31*i* when 31*a* and 31*b* are threadedly connected. The ends 31*j* and 31*k* engage the packing members forming packing means 33 and 34 and aid in retaining them in position.

It will be further noted that the packing 33 comprises two portions 33*a* and 33*b* which face in opposite directions as shown and similarly the packing 34 comprises packing rings 34*a* and 34*b* which face in opposite directions to aid in preventing flow of drilling fluid in either direction between the liner 14 and well string 20. Preferably the packing 33 and 34 is of a type that can withstand substantial temperatures without deleterious effects thereto.

The retrievable pack off bushing 30 also includes cooperating surface means referred to generally by the numeral 40 which are engagable to lock the body 31 in position between the liner 14 and well string 20 during lowering of the liner 14 and during cementing or bonding operations to inhibit improper flow of drilling fluids or bonding agent. In addition, lock ring means as referred to generally at 41 is positioned adjacent the cooperating surface means 40 of the FIG. 4 form to retain the cooperating surface means in engaged relation during the lowering and bonding operations. Releasable means referred to generally at 42 are provided for retaining the lock ring means in position during the lowering and cementing operations in the well bore and enabling the lock ring 41 to be moved when desired.

It will be noted that the cooperating surface means 40 includes a collet 45 formed by a plurality of longitudinally extending and circumferentially spaced slots formed adjacent the end 47 of the body 31, and if desired each slot 46 may have at its end an enlargement 48 as shown. Such collet 45 also includes an annular projecting surface projection means 49 formed between each of the slots 46 on the outer surface 50 of the body 31 and a plurality of inwardly projecting surfaces 51 on the inner surface 52 of the body 31 as shown in FIG. 4 of the drawings. The projecting surfaces 49 are adapted to engage in the annular recess 55 formed in the liner 14, and it will be noted that the lock ring means 41 includes an enlargement 56 on its end which, when positioned by the releasable means 42 in the position shown in FIG. 4 of the drawings will engage the enlargements 51 and thus maintain the enlargements 49 engaged in the recess 55. This locks the retrievable pack off or seal bushing 30 in position between the well string 20 and liner 14 as the well string 20 and liner 14 are lowered into the well bore and during cementing or bonding operations.

It can be appreciated that the releasable means 42 of the FIG. 4 form comprises a shear pin of suitable strength which may be sheared upon engagement by the collar 20*b* which provides additional surface means forming an enlarged surface on the lower end of well string 20 in a manner as will be described.

When the well string 20 and collar 20*b* thereon is moved upwardly to engage the end 41*a* of the lock ring 41, the pin 42*a* is sheared whereupon continued upward movement of the well string 20 and enlargement 20*b* moves the lock ring 41 into the recess 60 formed immediately adjacent the collet 45 within the body 31.

After the lock ring 41 has been moved away from the cooperating surface means 40, continued upward movement of the well string 20 and enlargement 20*b* causes the portions of the collet 45 to flex inwardly so that the enlargements 49 may disengage from the annular recess 55 to enable the bushing 30 of the FIG. 4 form to be retrieved to the earth's surface along with the well string 20.

Figure 5:
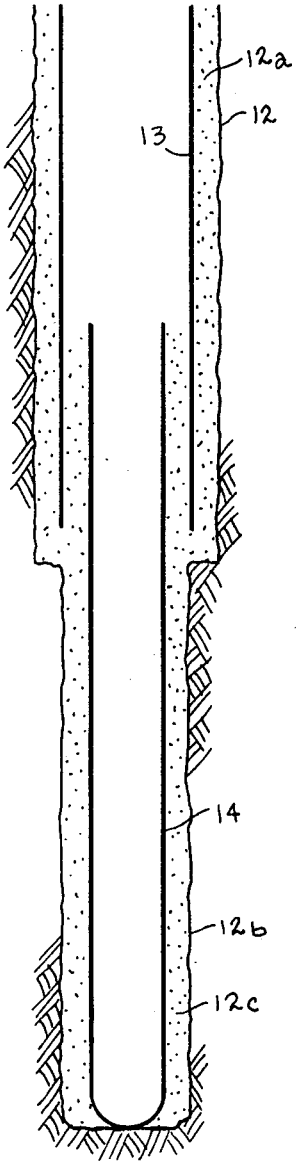
FIG. 5 is a schematic view showing a liner positioned in a casing in a well bore without a hanger.

FIG. 5 illustrates a well bore 12 having a casing 13 bonded therein by cement or other suitable bonding agent as represented at 12*a*. The portion 12*b* represents an extension of the well bore 12 and shows a liner 14 positioned therein with suitable bonding agent 12*c* positioned between the liner 14 and the extension 12*b* of the well bore 12 as well as between the lower portion of the casing 13 and the liner 14 therein. It will be noted that in FIG. 5, the liner 14 is not hung on casing 13, but rests on the bottom of the well bore extension 12*b*.

In FIG. 6 the well bore is again shown at 12 with a casing 13 positioned therein by suitable bonding such as cement as illustrated at 12*a*, and again the well bore is shown as extended at 12*b* with a liner 14 therein with suitable bonding agent as shown at 12*c* therebetween and between the upper portion of the liner 14 where it is surrounded by the casing 13.

Figure 6:
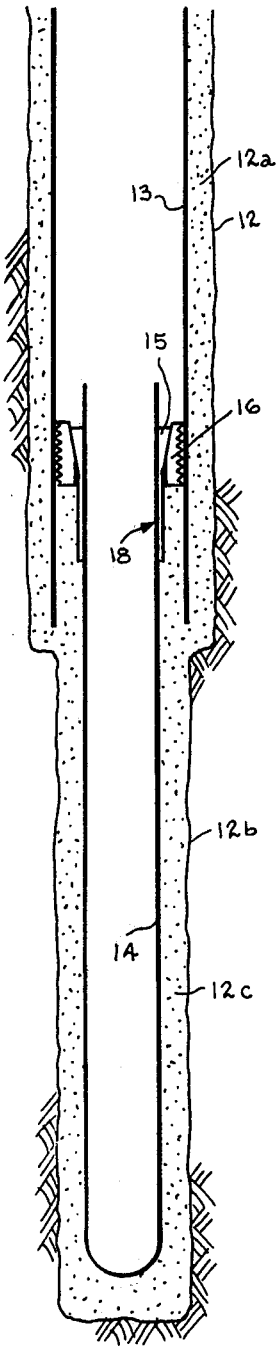
FIG. 6 is a schematic view showing a liner positioned in a casing in a well bore with a hanger.

FIG. 6 illustrates the arrangement where the liner 14 is hung in the casing 13 by means of the wedge 15 on the outer surface of the liner 14 and the slip segments 15 on the hanger 18.

In FIG. 7 the well bore is again illustrated at 12 with the casing 13 therein and a suitable bonding agent 12*a* between the casing 13 and surrounding well bore 12. The extension 12*b* is shown as being provided with a liner 14 which is to be hung in the casing 13 by the setting string or well string 20, and an alternate form of the seal bushing is illustrated generally at 30*a*.

The means for securing the well string 20 and the liner 14 releasably together are illustrated generally at 25.

After the bonding agent has been discharged out the lower end of the tubular member to surround the liner 14 and the adjacent wall of well bore extension 12*b* and between the liner 14 and casing 13, the seal bushing 30*a* may be unlocked from sealing engagement between the liner and well string and retrieved as the well string 20 is withdrawn from the well bore extension 12*b* and well bore 12.

Figure 7:
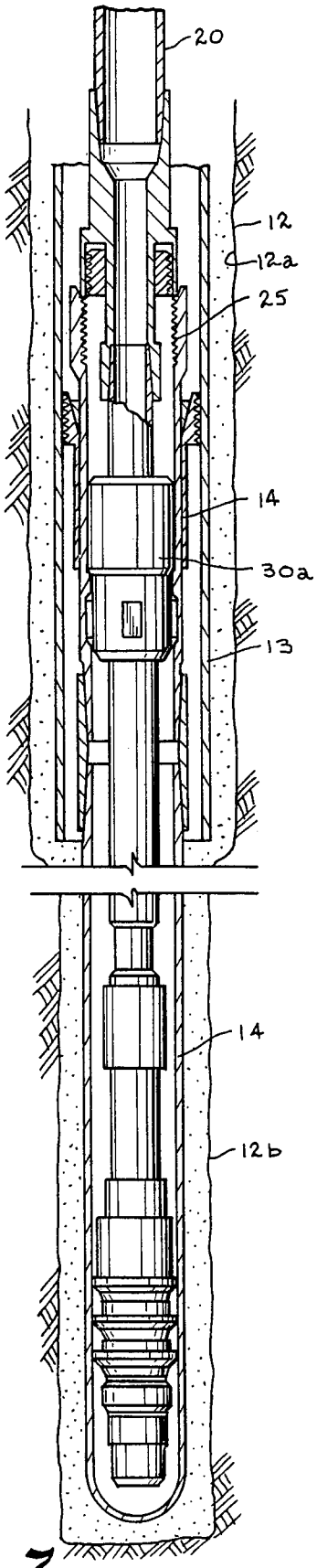
FIG. 7 shows a liner being set with another form of seal bushing of the present invention.
Figure 8:
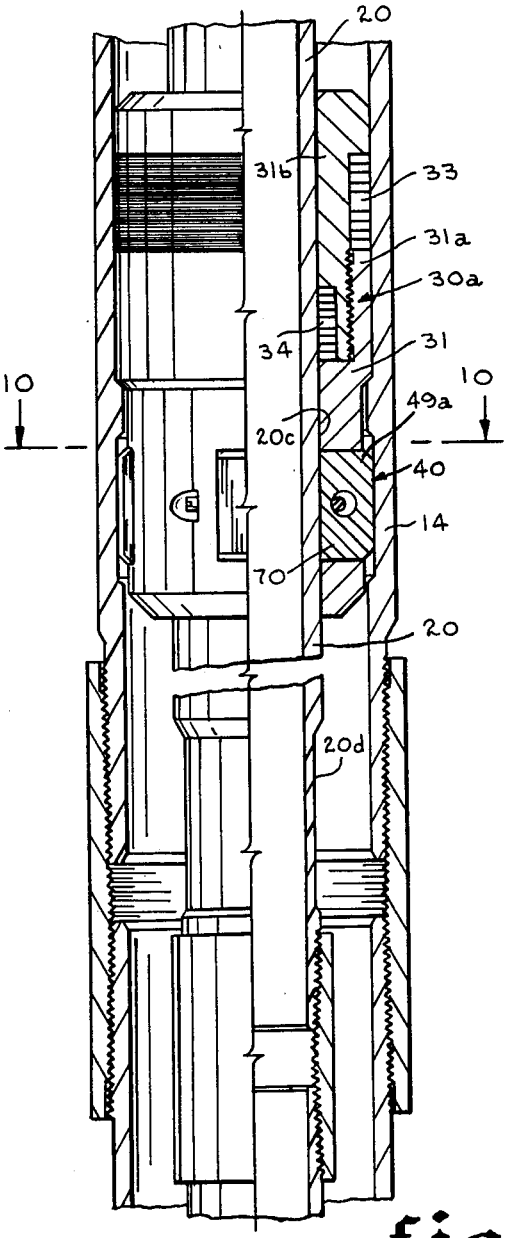
FIG. 8 is an enlarged partial sectional detail view of FIG. 7 showing in greater detail a form of seal bushing.
Figure 9:
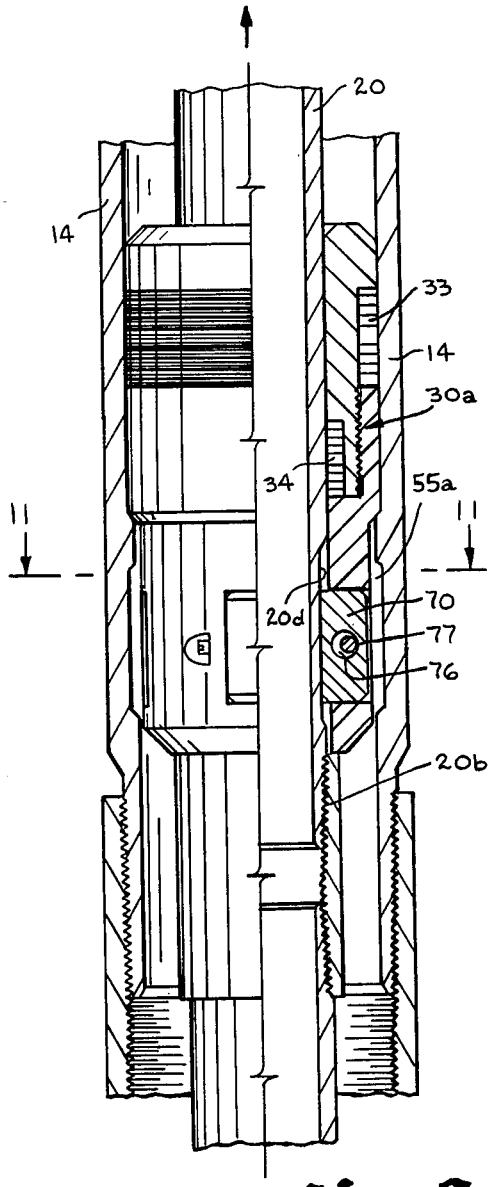
FIG. 9 is similar to FIG. 8, but shows the relationship of the components of the seal bushing of FIG. 7 when it is released and for retrieving it from the well bore.

FIGS. 8 and 9 are enlarged partial vertical sectional views of FIG. 7 showing in greater detail the alternate form of seal bushing 30*a* of FIG. 7. In FIG. 8 the seal bushing 30*a*, well string 20 and liner 14 are illustrated in their relative position when the seal bushing is in locked position therebetween.

In FIG. 9 the seal bushing 30*a*, the liner 14 and the well string 20 are illustrated in their position when the seal bushing 30*a* has been unlocked from the liner and is being retrieved along with the well string 20 to the earth's surface.

The form of the retrievable pack off bushing 30*a* includes a cylindrical body 31 constructed in a manner as described with regard to pack off bushing form 30 illustrated in FIG. 4. The body 31 includes the annular portions 31*a* and 31*b* which are adapted to be threadedly secured together as shown in FIGS. 4. and FIGS. 8 and 9. The arrangement of the recesses on the portion 31*b* of the pair of portions is as described with regard to FIG. 4 as is the arrangement of the packing means 33 and 34.

The retrievable pack off bushing 30*a* also includes cooperating surface means referred to generally by the numeral 40 which are engagable to lock the body 31 in position between the liner 14 and well string 20 during lowering of the liner 14 and during cementing or bonding operations to inhibit improper flow of drilling fluids or bonding agent. The cooperating surface means 40 includes an annular recess 55*a* on the inner surface of the liner 14 similar to the surface 55 of the FIG. 4 form.

Also, the body 31 includes a plurality of annular projecting surface means 49*a* which are adapted to seat in the circumferential recess 55*a* of the liner 14 to lock the seal bushing 30*a* therein as shown in FIG. 8 of the drawings. The projections means 49*a* is formed on the members 70 shown in greater detail in FIGS. 10 and 11. As shown, there are four of such members 70 provided, with each member 70 being slidably arranged in a passage which extends laterally through the body 31.

Suitable means as illustrated generally at 75 are provided for accommodating movement of the member 70 in the passages 71 while retaining such members 70 in position on the body 31, such means 75 including an opening 76 extending through each of the members with a pin 77 extending through the opening and into the adjacent sides of the body 31.

It will be noted that the width of the pin 77 is smaller than the extent of the opening 76 through each of the members 77 to accommodate movement of the member 70 laterally relative to the body 31.

Figure 10:
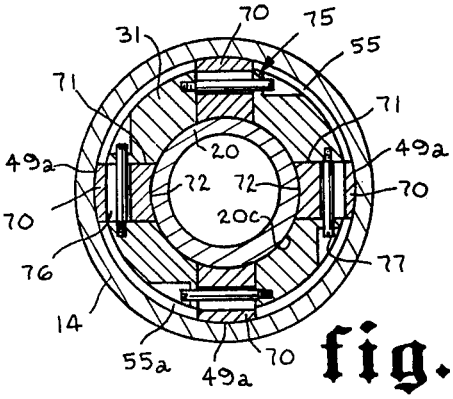
FIG. 10 is a sectional view on the line 10—10 of FIG. 8 and shows the relationship of the components of the seal bushing of FIG. 8 setting string and liner when the seal bushing is locked in sealing position in the liner.
Figure 11:
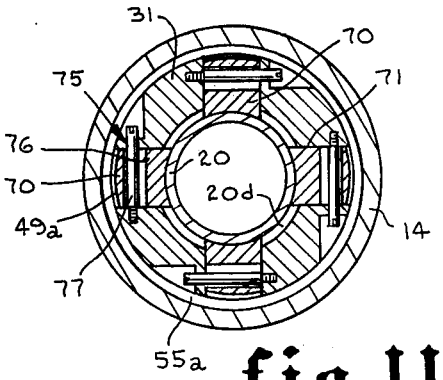
FIG. 11 is a sectional view on the line 11—11 of FIG. 9 and shows the relationship of the components of the seal bushing of FIG. 8 setting string and liner when the setting string has been moved to unlock the seal bushing for retrieval from the well bore.

When the members 70 are extended outwardly beyond the body 31 as shown in FIG. 10 of the drawings, the surface 20*c* of the well string 20 engages the inner end of the members 70 and maintains their projecting surfaces 49*a* in engagement in the recess 55*a* to lock 30*a* in sealing position as previously described.

The surface 20*c* on well string 20 is of suitable longitudinal extent so that after the hanger 14 has been hung on the casing 13, the well string 20 may be moved upwardly relative to the liner to assure that such liner 14 has been disengaged from the well string 20.

The well string 20 includes an additional surface means in the form of the annular recess 20*d* adjacent the end of surface 20*c*, and when the well string 20 is moved upwardly a sufficient amount, the surface of such recess 20*d* is positioned adjacent the members 70 to enable them to move inwardly out of the recess 55*a* as shown in FIG. 9 of the drawings upon continued upward movement of the well string 20. Immediately adjacent the circumferential recess 20*d* there is provided suitable projection means as in the form of a collar 20*b* to engage the lower end of the body 31 of the seal bushing 30*a* and withdraw it to the earth's surface along with the well string 20.

DESCRIPTION OF OPERATION

By way of further amplification and description, it can be appreciated that the liner 14 is initially secured with the hanger 18 thereon on the well string 20 by first of all positioning the hanger 18 and its J-slot arrangement in engagement with the lugs on the liner 14 in a manner well known in the art.

The seal bushing 30 may be positioned between the well string 20 and the liner 14 so that the cooperating surface means 40 positions either the bushing 30 or the form 30*a* and locks it in position between the liner 14 and well string 20.

It can also be appreciated that the well string 20 is threadedly engaged with the liner 14 at the earth's surface by reason of the threaded connection 25 so that they may be threadedly disengaged upon relative rotation.

Thereafter the well string 20, liner 14 and hanger 18 along with the bushing 30 or 30*a* positioned between the liner 14 and well string 20 is lowered into the well bore to a desired elevation or position.

The hanger 18 is expanded by first rotating the well string 20 a partial turn to the left to disengage the J-slot and lug arrangement on the hanger 18 and liner 14 respectively. Since the hanger 18 includes bow springs 17 thereon, after the hanger 18 has been disengaged from the liner 14 further downward movement of the well string 20 and liner 14 will cause the hanger 18 to force the slips 16 thereof onto the conical surface 15 on the outside of the liner 14. This causes the slip segments 16 to seat against the casing 13 and position the liner 14 on the casing 13 within the well bore 12.

Thereafter the well string 20 is disengaged from the liner 14 by relative rotation so that the threaded portion 25 between the liner 14 and well string 20 disengages, however, it is to be noted that such disengagement does not cause any relative movement of the seal bushing of either form relative to either the liner 14 or the well string 20. Thus, any damage to the packing carried by the packing bushing is lessened. The well string is set down on the liner for further operations.

Thereafter fluids such as cement may be discharged down the well string 20 from the earth's surface and pumped around the liner 14 in the well bore a suitable vertical extent to assure proper cementing or bonding thereof in the well bore.

Since the well string 20 has been disconnected from th liner 14, prior to the time that the cement or other bonding agent is discharged downwardly therethrough, after the bonding operation is completed, the well string 20 may be lifted vertically whereupon the enlargement 20*b* on the lower end thereof is moved upwardly to engage the lower end 41*a* of the lock ring 41 and shear the pin 42 and then move the lock ring 41 into the recess 60 as previously described with regard to the FIG. 4 form.

This enables the cooperating surfaces 40 to disengage whereupon the seal bushing 30 by reason of its engagement with the coupling 20*b* may by moved upwardly through the liner and retrieved at the earth's surface along with the tubular member.

Similarly, if the form of seal bushing 30*a* shown in FIGS. 8–11 is used, when the coupling or enlargement 20*b* engages the seal bushing 30*a*, the annular recess 20*d* enables the members 70 to disengage or unlock from recess 55*a* so that the seal bushing 30*a* may then be retrieved with well string 20 from the well.

The foregoing disclosure and description of the invention are illustrative and explanatory thereof, and various changes in the size, shape, and materials as well as the details of the illustrated construction may be made without departing from the spirit of the invention.

What is claimed is:

1. A retrievable pack off bushing for sealing between a liner and tubular member in a well string during bonding operations in a well bore comprising:

(a) body means for fitting between the liner and tubular member;

(b) seal means on said body for engaging the liner and tubular member for sealing therebetween;

(c) cooperating surface means on the liner, tubular member and said body means engagable with each other to lock said body means to the liner for sealing between the liner and tubular member while accommodating axial movement of the tubular member; and (d) means to unlock said cooperating surface means from each other upon a predetermined amount of further relative longitudinal movement between the tubular member and said body means whereby said body means may be retrieved with the tubular member and well string from the well bore.

2. The invention of claim 1 wherein said body means is a hollow cylindrical member.

3. The invention of claim 2 including:

(a) a plurality of passage extending laterally through said hollow cylindrical member;

(b) members slidably mounted in the passages; and (c) cooperating means on said body and members to accommodate radial movement of said members relative to said body while retaining said members on said body means.

4. The invention of claim 3 wherein said cooperating means includes openings in said members and pin means in said body and extending through said openings, said pin means being smaller in thickness than the size of the openings to accommodate movement of said members in the passages.

5. The invention of claim 3 wherein the tubular member includes surface means for engaging said members and urging them radially outward of said body means and additional surface means which accommodate movement of said members into said body means.

6. The invention of claim 1 wherein the cooperating surface means on the tubular member includes:

(a) lock ring means carried on the tubular member and telescopically positioned within said body means adjacent said cooperating surface means on said body means and the liner to retain said cooperating surface means on said body means and the liner in engaged relation and thereby maintain said body means in locked position between the liner and tubular member; and (b) shear pin means retaining said lock ring adjacent said cooperating surface means on said body means and the liner, said lock ring and shear pin means being constructed and arranged to release upon a predetermined amount of longitudinal movement of the tubular member relative to said body means.

7. The invention of claim 6 wherein said means to unlock includes an enlargement on said tubular member forming additional surface means for engaging said lock ring means when said tubular member is moved longitudinally relative to said body means a predetermined amount to release said shear pin means whereby said lock ring means may be moved with the tubular member to thereby release said cooperating surface means from each other.

8. The invention of claim 1 wherein:

(a) said cooperating surface means include:

(1) a recess in the liner;

(2) projection means on said body means engagable in the liner recess; and (3) surface means carried on the tubular member to urge said projection means into the recess in the liner to maintain said projection means engaged in the liner recess; and (b) said means to unlock including additional surface means on the tubular member which is positionable when the tubular member is moved longitudinally a predetermined amount relative to said body means to release said cooperating surface means on the liner, tubular member and said body means from each other.

9. The invention of claim 8 wherein said additional surface means on the tubular member is a recess for receiving said projection means.

10. The invention of claim 8 wherein said additional surface means on the tubular member is an enlargement on the tubular member for engaging and moving said projection means with the tubular member.

11. The invention of claim 1 wherein said body means includes a pair of annular portions threadedly connected together to form a cylindrical member having inner and outer surfaces and wherein one of said pair of annular portions includes a recess having a circumferential surface and a radially extending end surface on its said inner and outer surface for receiving said seal means.

12. The invention of claim 11 wherein the other of said pair of annular portions includes an end surface which is spaced relative to said radial end surface of the recess on said one annular member when they are threaded together and for engaging the seal means to retain it in position on said body.

13. The invention of claim 1 wherein said means to unlock the cooperating surface means includes additional surface means that is positionable adjacent said body means when the tubular member is moved longitudinally relative to said body means a predetermined amount to release said cooperating surface means from each other.

14. Apparatus for cementing a liner in a well bore including:

(a) a setting string which extends longitudinally in the liner;

(b) seal means releasably locked to the liner and sealingly engaging between said setting string and liner permitting at least limited axial movement of said setting string without movement of said seal means; and (c) cooperating means on said seal means, setting string and the liner to releasably lock said seal means against axial displacement while accommodating limited axial movement of said setting string, said cooperating means operable upon predetermined longitudinal movement of the setting string to unlock said seal means from the liner for removal with said setting string from the well bore.

15. The invention of claim 14 wherein said cooperating means includes:

(a) an enlargement on said seal means engagable with corresponding groove means in the liner;

(b) releasable means releasably secured to said seal means and abutting said enlargement and setting string to retain said seal means locked with the liner; and (c) shoulder means on said setting string to engage and move said releasable means upon predetermined longitudinal movement of said setting string whereby said enlargement and groove means disengaged to unlock said seal means from the liner.

16. The invention of claim 14 wherein said seal means includes a cylindrical body carrying first annular seal means for engaging the interior of the liner and second annular seal means for engaging the exterior of said setting string.

17. The invention of claim 16 wherein said setting string includes hanger means operable to secure the liner in position in the well bore.

18. The invention of claim 17 wherein said setting string is initially attached to the liner by connector means operable upon relative rotation between said setting string and the liner to release said setting string from the liner for axial movement of said setting string relative to the liner.

19. A retrievable pack off bushing for sealing between a liner and tubular member in a well string during bonding operations in a well bore comprising:

(a) body means for fitting between the liner and tubular member;

(b) hanger means carried by said setting string operable to engage and hang the liner in the well bore;

(c) connector means connecting the liner to said setting string and operable upon rotation of said setting string to release said setting string from the liner for axial movement of said setting string;

(d) seal means on said body means for engaging the liner and tubular member for sealing therebetween;

(e) cooperating surface means on the liner, tubular member and said body means engagable with each other to lock said body means to the liner for sealing between the liner and tubular member upon axial movement of the tubular member; and (f) means to unlock said cooperating surface means from each other upon a predetermined amount of further relative longitudinal movement between the tubular member and said body means whereby said body means may be retrived with the tubular member and well string from the well bore.

20. Apparatus for cementing a liner in a well bore comprising:

(a) a setting tool having a tubular mandrel connected in a pipe string for extension through said liner;

(b) seal means releasably attached to said liner and sealingly engaging the exterior of said mandrel and the interior of said liner permitting at least limited axial movement of said mandrel without movement of said seal means;

(c) latch means included with said seal means engagable with corresponding groove means within said liner to releasably hold said seal means against axial displacement therein; and (d) said mandrel comprising a first portion and an axially spaced second portion of less diameter than said first portion, said first portion when in registration with said latch means preventing disengagement of said latch means from said groove means, said second portion when in registration with said latch means allowing disengagement of said latch means from said groove means.

21. Apparatus as set forth in claim 20 in which said seal means comprises a sleeve member carrying a first annular seal for sealing engagement with said liner and a second annular seal for sealing engagement with said mandrel.

22. Apparatus as set forth in claim 21 in which said latch means comprises a plurality of latch members radially movable between extended positions, in which said latch members engage said groove means, and retracted positions, in which said latch members are not in engagement with said groove means.

23. Apparatus set forth in claim 22 in which said mandrel is initially attached to said liner by connector means operable upon rotation of said mandrel to release said mandrel for said limited axial movement relative to said liner.

24. Apparatus as set forth in claim 23 in which said connector means comprises threads in said liner engageable with threads carried by said mandrel.

25. Apparatus for cementing a liner in a well bore comprising:

(a) a setting tool having a tubular mandrel connected in a pipe string for extension through said liner;

(b) seal means releasably attached to said liner and sealingly engaging the exterior of said mandrel and the interior of said liner permitting at least limited axial movement of said mandrel without movement of said seal means;

(c) said seal means comprising a first sleeve carrying a first annular seal for sealing and sliding engagement with said mandrel and a second sleeve carrying a second annular seal for sealing engagement with said liner;

(d) said seal means comprising latch means engageable with corresponding groove means within said liner to releasably hold said seal means against axial displacement therein.

* * * * *

REEXAMINATION CERTIFICATE (304th)

United States Patent [19]

Braddick et al.

[11] B1 4,281,711

[45] Certificate Issued Feb. 19, 1985

[54] APPARATUS FOR POSITIONING A LINER ON A TUBULAR MEMBER IN A WELL BORE WITH A RETRIEVABLE PACK OFF BUSHING THEREBETWEEN

[75] Inventors: Britt O. Braddick, Houston; Hiram E. Lindsey, Midland, both of Tex.

[73] Assignee: Texas Iron Works, Inc., Houston, Tex.

Reexamination Request:
No. 90/000,517, Mar. 2, 1984

Reexamination Certificate for:

| | |
|---|---|
| Patent No.: | **4,281,711** |
| Issued: | **Aug. 4, 1981** |
| Appl. No.: | **555,691** |
| Filed: | **Mar. 5, 1975** |

Related U.S. Application Data

[62] Division of Ser. No. 440,714, Feb. 8, 1974, Pat. No. 3,920,075.

[51] Int. Cl.[3] ..... E21B 33/14

[52] U.S. Cl. ..... 166/118; 166/217; 166/237; 285/3; 285/307; 285/319

[58] Field of Search ..... 166/123-125, 166/118, 128, 138, 208, 217, 226, 237, 381, 387, 386

[56] References Cited

U.S. PATENT DOCUMENTS

| | | | |
|---|---|---|---|
| 2,343,075 | 2/1944 | Otis | 166/119 |
| 2,506,680 | 5/1950 | Otis . | |
| 2,798,559 | 7/1957 | Fredd | 166/125 |
| 2,894,586 | 7/1959 | Schramm et al. | 166/125 |
| 2,980,185 | 4/1961 | Daffin | 166/211 |
| 3,109,490 | 11/1963 | Baker | 166/114 |
| 3,171,490 | 3/1965 | States | 166/124 |
| 3,227,218 | 4/1966 | Fisher et al. | 166/216 |
| 3,291,220 | 12/1966 | Mott | 166/208 |
| 3,346,050 | 10/1967 | Brown | 166/128 |
| 3,364,996 | 1/1968 | Brown | 166/211 |
| 3,608,634 | 9/1971 | Cochran | 166/208 |

*Primary Examiner*—James A. Leppink
*Assistant Examiner*—William P. Neuder

[57] ABSTRACT

A method and apparatus for positioning and bonding a liner in a casing in a well bore wherein a pack off bushing is provided between the liner and the well string on which the liner is lowered into the well bore for discharge of a bonding agent through the well string and around the liner in the well bore.

The seal or pack off bushing is constructed and arranged so that it may be retrieved after the positioning and bonding operations are completed along with the well string upon which the liner is initially lowered into the well bore.

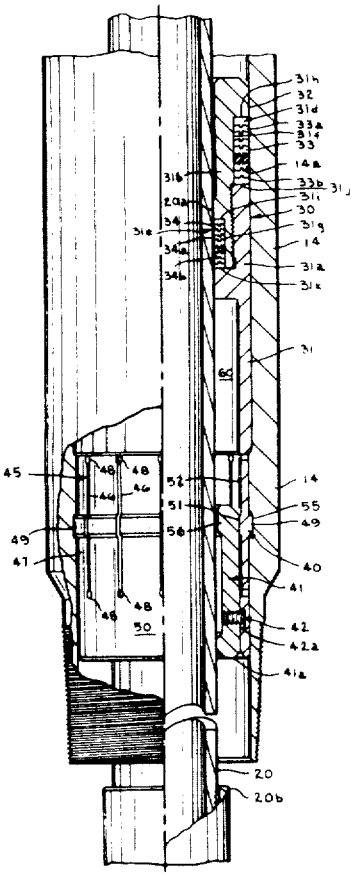

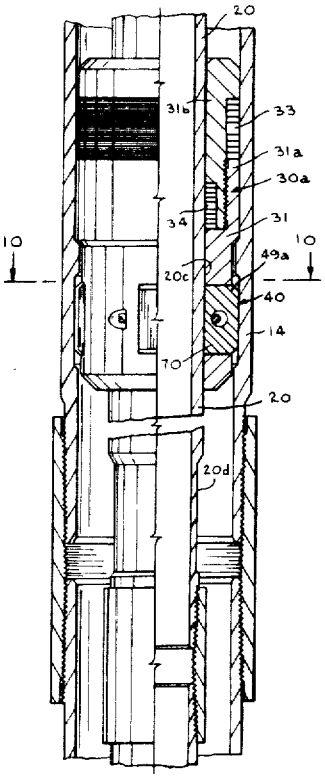

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 14, 19, 20 and 25 are determined to be patentable as amended.

Claims 2–13, 15–18, and 21–24, dependent on an amended claim, are determined to be patentable.

1. A retrievable pack off bushing for sealing between a liner and tubular member in a well string during bonding operations in a well bore comprising:

(a) body means for fitting between the liner and tubular member;

(b) seal means on said body *means* for engaging the liner and tubular member for sealing therebetween[;]. *said seal means positioned to avoid communication between the inside and the outside of the liner throughout the length of the liner below said body means and above where bonding agent is discharged from the liner into the well bore;*

(c) cooperating surface means on the liner, tubular member and said body means [engagable] *engageable* with each other to lock said body means to the liner for sealing between the liner and tubular member while accommodating axial movement of the tubular member; and (d) means to unlock said cooperating surface means from each other upon a predetermined amount of further relative longitudinal movement between the tubular member and said body means whereby said body means may be retrieved with the tubular member and well string from the well bore.

14. Apparatus for cementing a liner in a well bore including:

(a) a setting string which extends longitudinally in the liner;

(b) seal means releasably locked to the liner and sealingly engaging between said setting string and liner permitting at least limited axial movement of said setting string without movement of said seal means[; and]. *said seal means positioned to avoid communication between the inside and the outside of the liner throughout the length of the liner below said seal means and above where cement is discharged from the liner into the well bore; and*

(c) cooperating means on said seal means, setting string and the liner to releasably lock said seal means against axial displacement while accommodating limited axial movement of said setting string, said cooperating means operable upon predetermined longitudinal movement of the setting string to unlock said seal means from the liner for removal with said setting string from the well bore.

19. A retrievable pack off bushing for sealing between a liner and tubular member in a well string during bonding operations in a well bore comprising:

(a) body means for fitting between the liner and tubular member;

(b) hanger means carried by [said setting string] *the liner* operable to engage and hang the liner in the well bore;

(c) connector means connecting the liner to [said setting] *the well* string and operable upon rotation of [said setting] *the well* string to release [said setting] *the well* string from the liner for axial movement of [said setting] *the well* string;

(d) seal means on said body means for engaging the liner and tubular member for sealing therebetween[;]. *said seal means positioned to avoid communication between the inside and the outside of the liner throughout the length of the liner below said body means and above where bonding agent is discharged from the liner into the well bore;*

(e) cooperating surface means on the liner, tubular member and said body means [engagable] *engageable* with each other to lock said body means to the liner for sealing between the liner and tubular member upon axial movement of the tubular member; and (f) means to unlock said cooperating surface means from each other upon a predetermined amount of further relative longitudinal movement between the tubular member and said body means whereby said body means may be retrieved with the tubular member and well string from the well bore.

20. Apparatus for cementing a liner in a well bore comprising:

(a) a setting tool having a tubular mandrel connected in a pipe string for extension through said liner;

(b) seal means releasably attached to said liner and sealingly engaging the exterior of said mandrel and the interior of said liner permitting at least limited axial movement of said mandrel without movement of said seal means[;]. *said seal means positioned to avoid communication between the inside and the outside of the liner throughout the length of the liner below said seal means and above where cement is discharged from the liner into the well bore;*

(c) latch means included with said seal means [engagable] *engageable* with corresponding groove means within [said] *the* liner to releasably hold said seal means against axial displacement therein; and (d) said mandrel comprising a first portion and an axially spaced second portion of less diameter than said first portion, said first portion when in registration with said latch means preventing disengagement of said latch means from said groove means, said second portion when in registration with said latch means allowing disengagement of said latch means from said groove means.

25. Apparatus for cementing a liner in a well bore comprising:

(a) a setting tool having a tubular mandrel connected in a pipe string for extension through said liner;

(b) seal means releasably attached to said liner and sealingly engaging the exterior of said mandrel and the interior of said liner permitting at least limited axial movement of said mandrel without movement of said seal means[;]. *said seal means positioned to avoid communication between the inside and the out-*

*side of the liner throughout the length of the liner below said seal means and above where cement is discharged from the liner into the well bore;*

(c) said seal means comprising a first sleeve carrying a first annular seal for sealing and sliding engagement with said mandrel and a second sleeve carrying a second annular seal for sealing engagement with said liner; *and*

(d) said seal means [comprising] *including* latch means engageable with corresponding groove means within said liner to releasably hold said seal means against axial displacement therein.

* * * * *